US006302731B1

(12) United States Patent
Kring

(10) Patent No.: US 6,302,731 B1
(45) **Date of Patent: *Oct. 16, 2001**

(54) BRACKET FOR CONNECTOR

(75) Inventor: Jeffrey Lewis Kring, San Jose, CA (US)

(73) Assignee: Kycon, Incorporated, San Jose, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/397,599

(22) Filed: Sep. 16, 1999

(51) Int. Cl.[7] ..... H01R 13/60
(52) U.S. Cl. ..... 439/541.5; 439/540.1
(58) Field of Search ..... 439/541.5, 542, 439/79, 540.1; 248/200, 201, 205.1

(56) References Cited

U.S. PATENT DOCUMENTS

| | | | | |
|---|---|---|---|---|
| D. 414,465 | * | 9/1999 | Hsu et al. | D13/147 |
| 3,601,762 | | 8/1971 | Eshelman . | |
| 4,818,239 | | 4/1989 | Erk . | |
| 4,878,856 | | 11/1989 | Maxwell . | |
| 4,900,258 | | 2/1990 | Hnatuck et al. . | |
| 4,978,317 | | 12/1990 | Pocrass . | |
| 5,044,984 | | 9/1991 | Mosser et al. . | |
| 5,080,609 | * | 1/1992 | Fabian et al. | 439/540 |
| 5,219,294 | | 6/1993 | Marsh et al. . | |
| 5,249,974 | | 10/1993 | Wang . | |
| 5,267,876 | | 12/1993 | Rupert et al. . | |
| 5,318,463 | | 6/1994 | Broschard, III et al. . | |
| 5,591,035 | | 1/1997 | Burkholder et al. . | |
| 5,613,873 | | 3/1997 | Bell, Jr. . | |
| 5,700,157 | | 12/1997 | Chung . | |
| 5,704,802 | | 1/1998 | Loudermilk . | |
| 5,733,143 | * | 3/1998 | Ward et al. | 439/541.5 |
| 5,741,152 | | 4/1998 | Boutros . | |
| 5,772,453 | | 6/1998 | Tan et al. . | |
| 5,800,207 | | 9/1998 | Hsu et al. . | |
| 5,876,239 | | 3/1999 | Morin et al. . | |
| 5,885,100 | | 3/1999 | Talend et al. . | |
| 5,975,943 | | 11/1999 | Chou et al. . | |
| 6,027,370 | * | 2/2000 | Hsu et al. | 439/541.5 |
| 6,077,114 | * | 6/2000 | Lu | 439/541.5 |

OTHER PUBLICATIONS

"Leadership in Connector Design—Catalog No. 14," published by Kycon, Jun., 1998, pp. 1–120.
Pending Kycon U.S. Patent application No.: 09/634,116, Inventor: Kring, Filing Date: Aug. 8, 2000.

* cited by examiner

*Primary Examiner*—Tulsidas Patel
*Assistant Examiner*—Chandrika Prasad
(74) *Attorney, Agent, or Firm*—Brinks Hofer Gilson & Lione

(57) ABSTRACT

An electrical connector support system that includes a bracket having a base with a rear portion and a front portion and a second base positioned above and in front of the front portion of the base. An electrical connector is attached to the bracket and positioned over the second base so as not to be supported on the second base.

43 Claims, 4 Drawing Sheets

BRACKET FOR CONNECTOR

BACKGROUND OF THE INVENTION

1. Field of the Invention

The present invention relates to the field of connectors, in particular electrical connectors.

2. Discussion of Related Art

It is known in the art to employ an electrical device, such as a computer, that has multiple ports, such as VGA, mouse and keyboard ports. Often such ports are mounted in a complicated configuration and/or are mounted separately from one another. Using a complicated configuration for mounting multiple ports often results in an expensive mounting structure that can be hard to install. Mounting the ports a significant distance from one another can lead to increased expense in building the electrical device due to inefficient use of space. Separating the ports a significant distance from one another can complicate the task of connecting external devices, such as a monitor, mouse or keyboard, to the ports since the general location of each port needs to be identified instead of just one general location.

SUMMARY OF THE INVENTION

One aspect of the invention regards a bracket for supporting an electrical connector, the bracket includes a base with a rear portion and a front portion that define an opening located between two sides and a central side therebetween, wherein a portion of the central side does not face any portion of the base. A support extending upwardly from the front portion, wherein one end of the support is attached to the front portion. A second base has a rear portion that is attached to a second end of the support and a second support extends upwardly from the second base, wherein the second support is attached to a front portion of the second base.

A second aspect of the present invention regards a bracket for supporting an electrical connector that has a base with a rear portion and a front portion that define an opening located between two sides and a central side therebetween, wherein a portion of the central side does not face any portion of the base. A pair of supports extend upwardly from the front portion, wherein ends of the pair of supports are attached to the front portion. A second base includes a rear portion that is attached to second ends of the pair of supports, wherein there are no other supports for supporting the second base that are positioned between the pair of supports. A third support extends upwardly from the second base, wherein the third support is attached to a front portion of the second base.

A third aspect of the present invention regards an electrical connector support system that includes a bracket having a base with a rear portion and a front portion and a second base positioned above and in front of the front portion of the base. An electrical connector is attached to the bracket and positioned over the second base so as not to be supported on the second base.

A fourth aspect of the present invention regards an electrical connector that has a first casing with a terminal hole that extends along a first direction. A terminal is attached to the first casing, wherein a first end of the terminal is aligned with the terminal hole and a second end of the terminal extends along a second direction that is not aligned with the first direction. A second casing mates with the first casing, wherein the second casing has a terminal hole that is aligned with and receives the second end of the terminal.

A fifth aspect of the present invention regards an electrical connector support system that includes a bracket having a base and a support extending therefrom. An electrical connector is attached to the bracket and has a first casing that has a terminal hole that extends along a first direction. A terminal is attached to the first casing, wherein a first end of the terminal is aligned with the terminal hole and a second end of the terminal extends along a second direction that is not aligned with the first direction. The electrical connector further has a second casing that mates with the first casing, wherein the second casing has a terminal hole that is aligned with and receives a portion of the terminal.

Each of the above aspects of the present invention provides the advantage of an inexpensive mounting structure of an electrical connector that is easy to install.

Each of the above aspects of the present invention provides the advantage of allowing multiple ports to be mounted in a single general location that leads to reduced expenses in building an electrical device and improved ease in connecting external devices to each port.

The present invention, together with attendant objects and advantages, will be best understood with reference to the detailed description below in connection with the attached drawings.

DETAILED DESCRIPTION OF THE INVENTION

Figure 1:
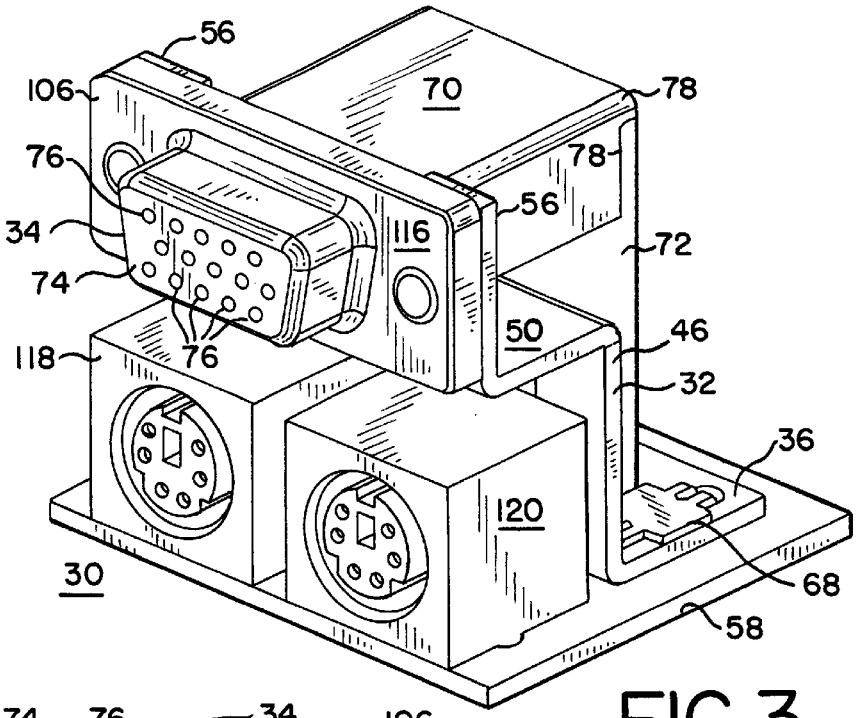
FIG. 1 is a front elevational perspective view of an embodiment of an electrical connector support system according to the present invention.
Figure 2:
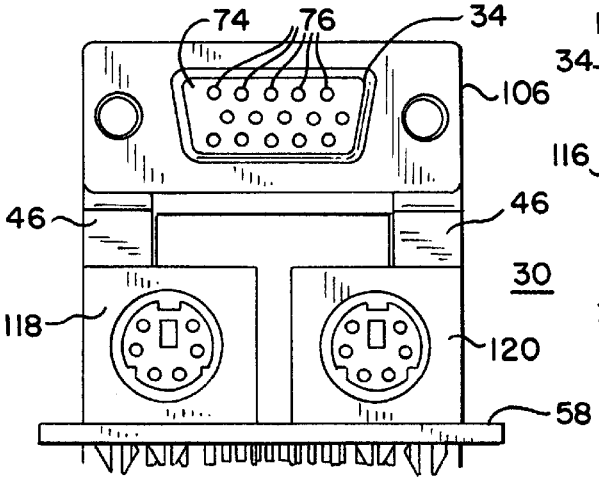
FIG. 2 is a front view of the electrical connector support system of FIG. 1.
Figure 3:
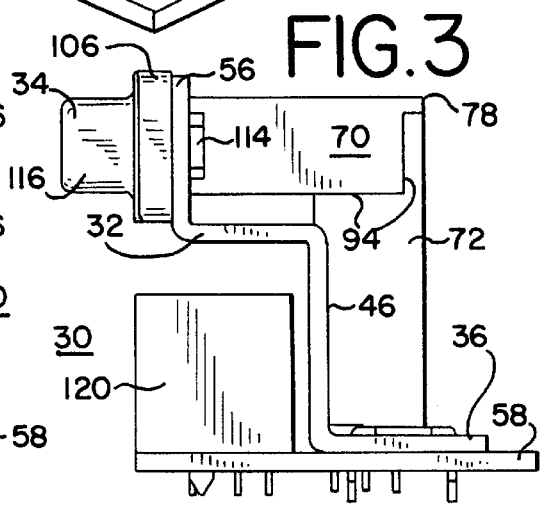
FIG. 3 is a side view of the electrical connector support system of FIG. 1.
Figure 4:
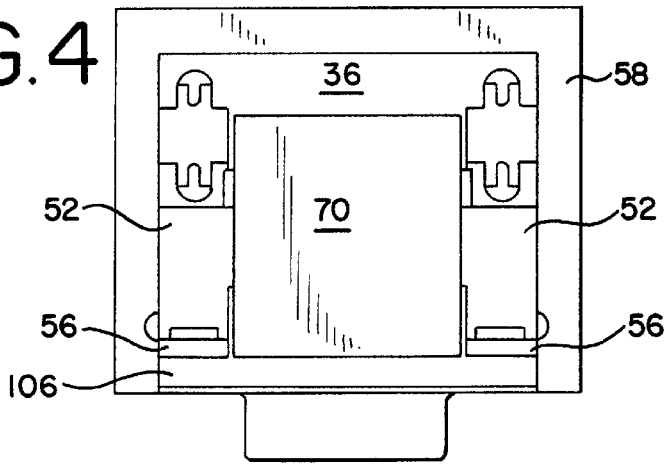
FIG. 4 is a top view of the electrical connector support system of FIG. 1.

Referring to the drawings, FIGS. 1–15 show an embodiment of an electrical connector support system 30 that includes a bracket 32 that supports an electrical connector, such as a D-Sub 34 that can function as a VGA port.

Figure 10:
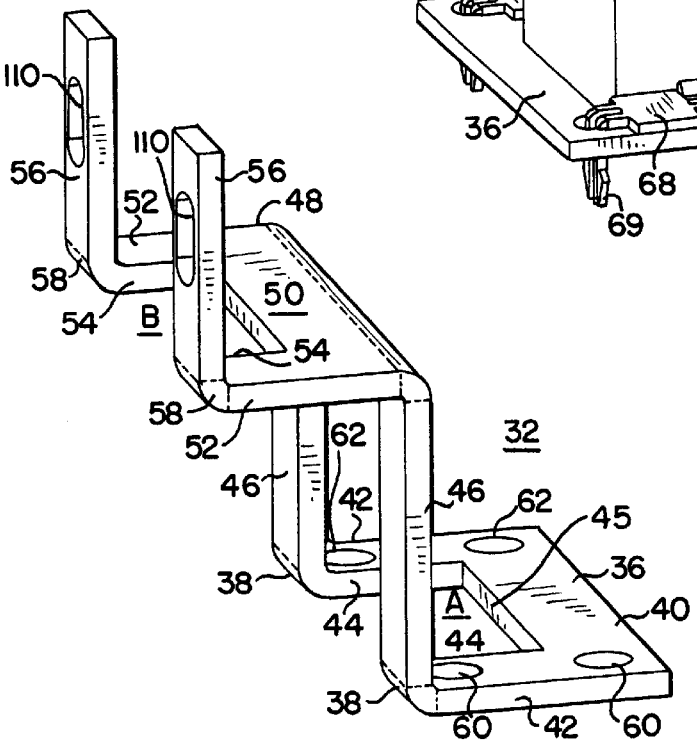
FIG. 10 is a left side perspective view of an embodiment of a bracket to be used in the systems of FIGS. 1–9.

An embodiment of the bracket 32 is shown in FIG. 10. The bracket 32 is preferably made of a single piece of a metal, such as tin-plated brass. The bracket 32 has a lower U-shaped base 36 that has a front portion 38 and a rear portion 40 that substantially lie in a plane. The U-shaped base 36 has a pair of rectangular arms 42 that are positioned parallel to one another. The interior edges or sides 44 of the base 36 along with the central edge or side 45 of the base 36 define in part a rectangular opening A. The opening A is not totally closed so that a portion of the side 45 does not face any portion of the base 36. The opening A has a length of approximately 9 mm and a width of approximately 19 mm.

A pair of 1.7 cm long rectangular-like supports 46 have their bottom ends integrally attached to the front ends of the arms 42 located at the front portion 38 of the lower base 36. The supports 46 extend approximately vertically upwardly with respect to the plane containing the base 36, are parallel to one another and are separated from one another by approximately 19 mm.

The top ends of the supports 46 are integrally attached to the rear portion 48 of an upper U-shaped base 50 that substantially lies in a plane that is located above and parallel to the plane containing the lower base 36. As shown in FIG. 10, the base 50 is positioned above and entirely in front of the front portion 38 of the lower base 36. The U-shaped base 50 has a pair of rectangular arms 52 that are positioned parallel to one another so that their interior edges 54 define in part a rectangular opening B having a length of approximately 6.5 mm and a width of approximately 19 mm.

A pair of rectangular-like supports 56 have their bottom ends integrally attached to the front ends of the arms 52 located at the front portion 58 of the upper base 50. As shown in FIG. 10, the supports 56 extend approximately vertically upwardly with respect to the plane containing the base 50 by a distance of approximately 13 mm. The supports 56 are parallel to one another and are separated from one another by approximately 19 mm.

Figure 5:
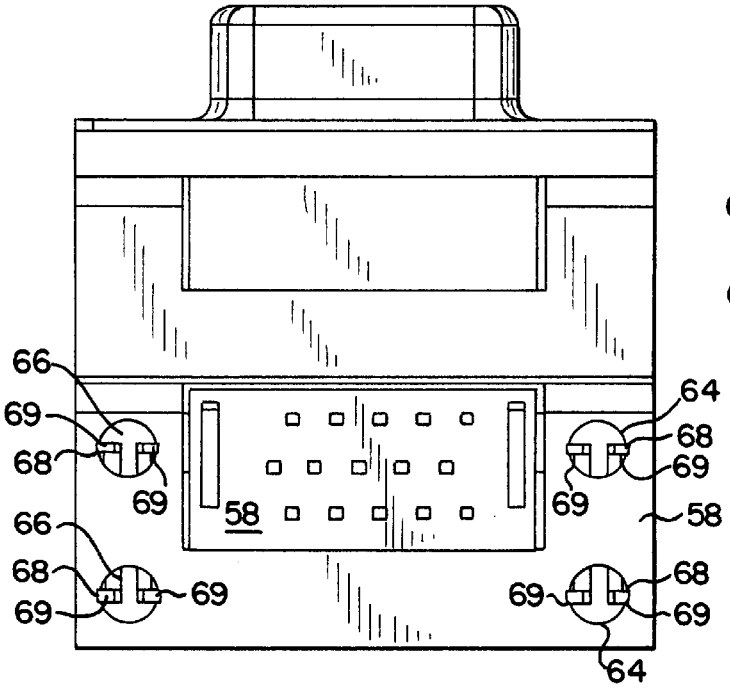
FIG. 5 is a bottom view of the electrical connector support system of FIG. 1.
Figure 6:
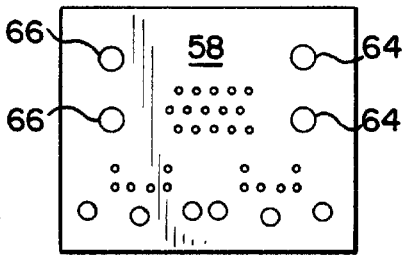
FIG. 6 is a top view of an embodiment of a PC board to be used with the electrical connector support system of FIG. 1.
Figure 7:
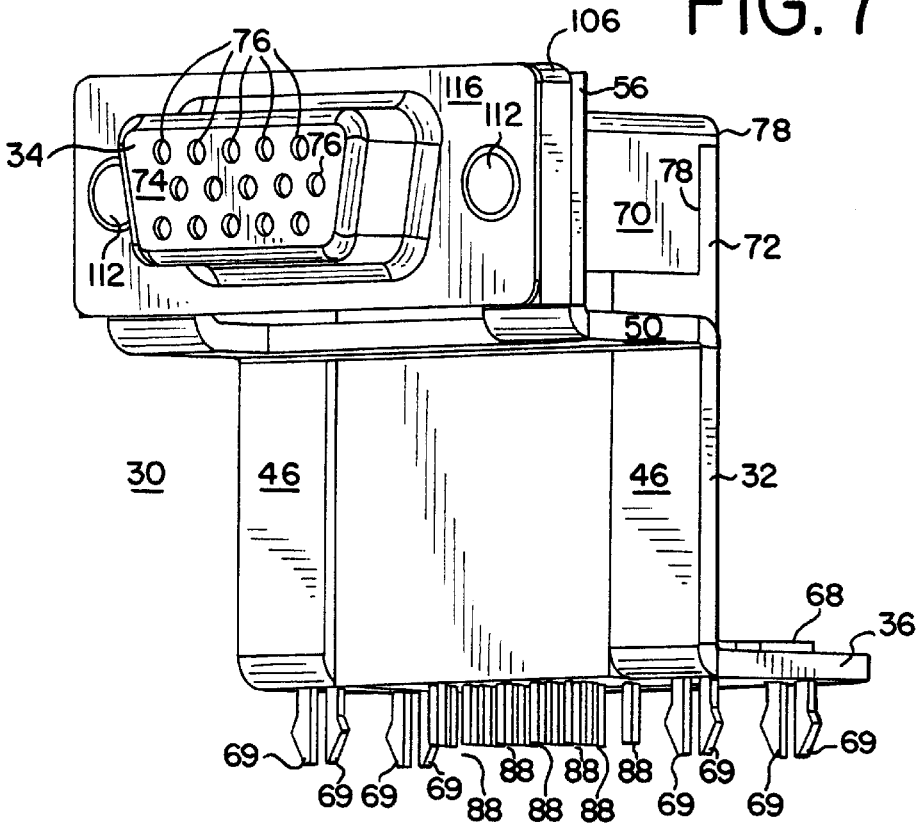
FIG. 7 is an enlarged perspective view of the attachment between an embodiment of a bracket and an electrical connector to be used with the electrical connector support system of FIG. 1.
Figure 8:
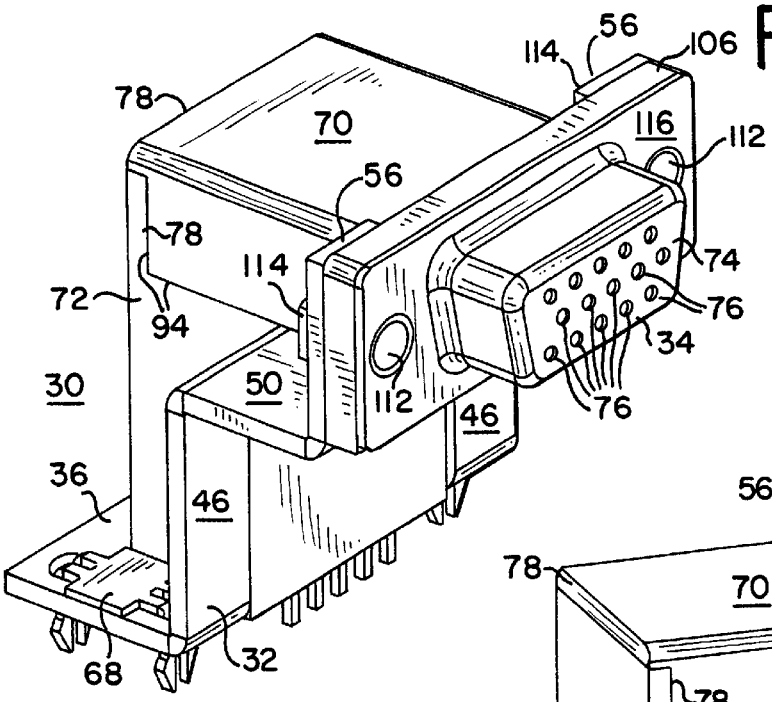
FIG. 8 is a top perspective view of the bracket and electrical connector of FIG. 7.
Figure 9:
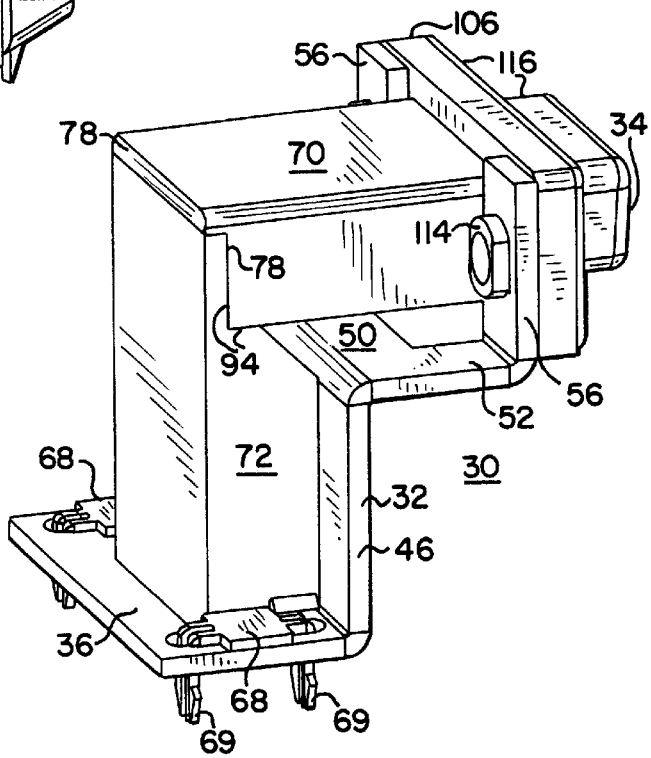
FIG. 9 is a right side perspective view of the bracket and electrical connector of FIG. 7.

The bracket 32 is preferably used to support a D-Sub connector 34 that is electrically attached to a PC board 58 as shown in FIGS. 1–6. The lower base 36 has two pairs of openings 60, 62 that are positioned over corresponding aligned openings 64, 66 formed in the PC board 58. A pair of PC board locks 68 are inserted through the aligned openings and have arms 69 that engage the bottom surface of the PC board in a well known manner as shown in FIG. 5 so as to prevent the bracket 32 from tipping.

Figure 11:
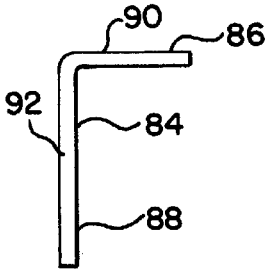
FIG. 11 is a side view of a terminal to be used with the electrical connector of FIGS. 1–9.
Figure 12:
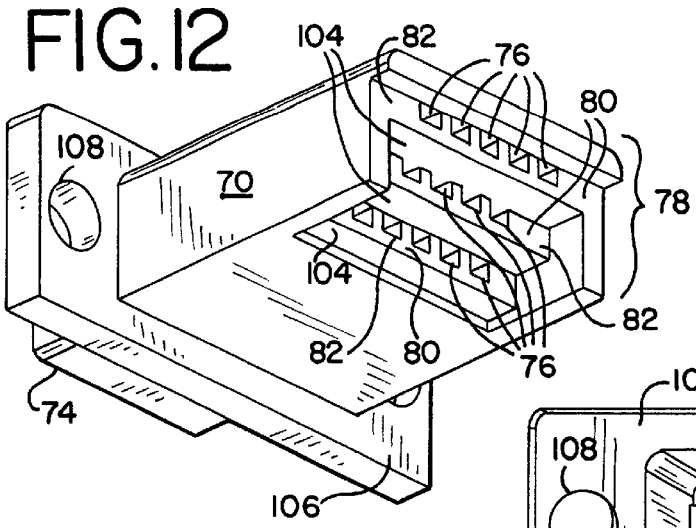
FIG. 12 shows a bottom side perspective view of a top casing of the electrical connector of FIGS. 1–9.
Figure 13:
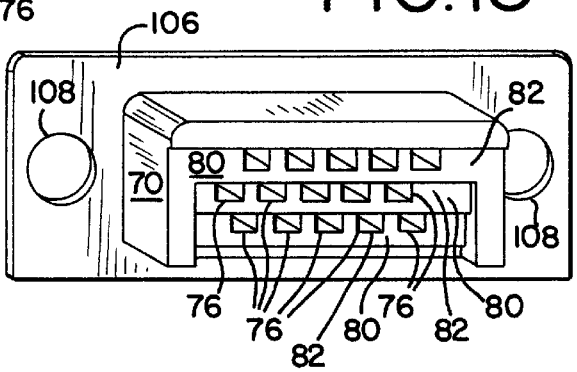
FIG. 13 shows a rear view of the top casing of FIG. 12.

An embodiment of an electrical connector to be supported by the bracket 32 is shown in FIGS. 1, 3, 8, 9 and 11–15. The connector 34 includes a pair of plastic casings 70, 72 that mate with one another so as to define an L-shaped connector 34. As shown in FIGS. 1, 2, 7 and 8, the upper casing 70 has an exterior front face 74 that has one or more terminal holes or openings 76 that extend along a horizontal direction from the front face 74 to a rear portion 78 of the casing 70. As shown in FIGS. 12 and 13, the rear portion 78 of the casing 70 has a plurality of stepped portions 80, wherein each of the stepped portions has a rear face 82 through which the openings 76 extend therethrough. Terminals 84 are inserted into the openings 76 by aligning the ends 86 of the terminals 84 with the openings 76 of the rear faces 82 of the casing 70 and inserting the ends 86 therethrough. The other ends 88 of the terminals 84 extend along a downward direction that is perpendicular to the horizontal direction that the ends 86 extend.

As shown in FIG. 11, each terminal 84 is L-shaped having a first leg 90 with a length of approximately 25 mm and a second leg 92 that is perpendicular to the first leg 90 and has a length of approximately 31 mm. Each terminal 84 is made of a conductive material such as phosphor bronze and is either cylindrical having a diameter of approximately 0.65 mm or rectangular having a width and depth of approximately 0.65 mm.

Figure 14:
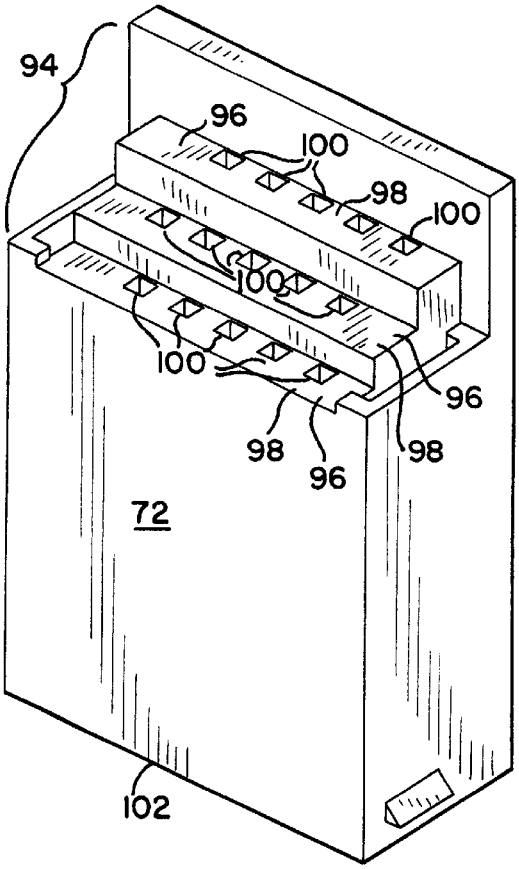
FIG. 14 shows a front perspective view of a back casing of the electrical connector of FIGS. 1–9.
Figure 15:
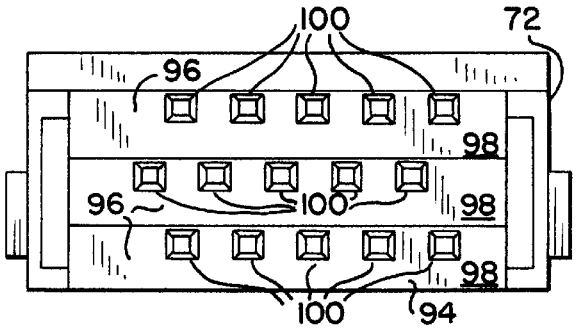
FIG. 15 shows a top view of the top casing of FIG. 14.

As shown in FIGS. 14 and 15, the top portion 94 of the back casing 72 has a plurality of stepped portions 96. Each stepped portion 96 has a top face 98 with one or more openings 100 that extend vertically downward to a bottom face 102 of the casing 72. The ends 88 of the terminals 84 are inserted through the openings 100 from the top face 98 and out past the bottom face 102. The stepped portions 96 are dimensioned so as their top faces 98 mate with the bottom faces 104 of the stepped portions 80 of the casing 70.

Attachment of the L-shaped connector 34 to the bracket 32 is accomplished by inserting the rectangular bottom face 102 of the connector 34 into the opening A of the base 36. The interior edges 44 of the arms 42 of the base 36 engage the sides of the connector 34. In addition, a vertical flange 106 formed in the casing 70 is positioned forwardly of and adjacent to the supports 56 of the bracket 32. The flange 106 has a pair of threaded holes 108 that are aligned with corresponding threaded holes 110 formed in the supports 56. Rivets 112 are inserted into the aligned holes so as to pass through the holes 110 in the supports 56 and through the holes 108 of the connector 34. The rivets 112 are then compressed, permanently attaching the connector 34 to the bracket 32 so as to provide improved alignment and stability of the connector 34. Once attached, the electrical connector 34 is separated from and positioned over the upper base 50. Note that a metal cover 116 preferably is placed over the front face 74 and attached to the flange 106 via the rivets 112 by having the rivets 112 inserted through openings formed in the cover 116.

As mentioned previously, the bracket 32 is attached to the PC board 58 by a pair of PC board locks 68. A pair of additional electrical connectors, such as mini-Dins 118 and 120, can be electrically attached to the PC board 58 below the upper base 50 of the bracket 32 and positioned in front of the back casing 72 and the front portion 38 of the lower base 36. The front edges of the connector 34 are preferably substantially aligned with and above the front edges of the connectors 118 and 120. Note that connector 118 may be a mouse port and connector 120 may be a keyboard port.

The foregoing description is provided to illustrate the invention, and is not to be construed as a limitation. Numerous additions, substitutions and other changes can be made to the invention without departing from its scope as set forth in the appended claims.

I claim:

1. A bracket for supporting an electrical connector, said bracket comprising:

a base comprising a rear portion, a front portion, two sides and a central side therebetween, wherein said two sides and said central side define an opening that is not totally enclosed, and wherein a portion of said central side faces said opening but does not face said base;

a first support extending upwardly from said front portion, wherein one end of said first support is attached to said front portion;

a second base comprising a rear portion that is attached to a second end of said support; and a second support extending upwardly from said second base, wherein said second support is attached to a front portion of said second base.

2. The bracket of claim 1, wherein said base, first support, second base and second support are integral with one another.

3. The bracket of claim 1, wherein said base extends along a plane.

4. The bracket of claim 1, wherein said second base extends along a plane.

5. The bracket of claim 3, wherein said second base extends along a second plane that is parallel with said plane.

6. The bracket of claim 1, wherein said base is U-shaped comprising a first arm and a second arm.

7. The bracket of claim 6, wherein said first support is attached to said first arm.

8. The bracket of claim 1, wherein said second base is U-shaped comprising a first arm and a second arm.

9. The bracket of claim 8, wherein said second support is attached to said first arm.

10. The bracket of claim 6, wherein said second base is U-shaped comprising a first arm and a second arm.

11. The bracket of claim 10, wherein said second support is attached to said first arm of said second support.

12. The bracket of claim 5, wherein said first support is vertical with respect to said plane.

13. The bracket of claim 5, wherein said second support is vertical with respect to said plane.

14. The bracket of claim 12, wherein said second support is vertical with respect to said plane.

15. A bracket for supporting an electrical connector, said bracket comprising:

a base comprising a rear portion, a front portion, two sides and a central side therebetween, wherein said two sides and said central side define an opening that is not totally enclosed, and wherein a portion of said central side faces said opening but does not face said base;

a first support extending upwardly from said front portion, wherein one end of said first support is attached to said front portion;

a second support extending upwardly from said front portion, wherein one end of said second support is attached to said front portion;

a second base comprising a rear portion that is attached both to a second end of said first support and a second end of said second support, wherein there are no other supports for supporting said second base that are positioned between said first and second supports; and a third support extending upwardly from said second base, wherein said third support is attached to a front portion of said second base.

16. The bracket of claim 15, wherein said base, first support, second support, second base and third support are integral with one another.

17. The bracket of claim 15, wherein said base extends along a plane.

18. The bracket of claim 15, wherein said second base extends along a plane.

19. The bracket of claim 17, wherein said second base extends along a second plane that is parallel with said plane.

20. The bracket of claim 15, wherein said base is U-shaped comprising a first arm and a second arm.

21. The bracket of claim 20, wherein said first support is attached to said first arm.

22. The bracket of claim 15, wherein said second base is U-shaped comprising a first arm and a second arm.

23. The bracket of claim 22, wherein said third support is attached to said first arm of said second base.

24. The bracket of claim 20, wherein said second base is U-shaped comprising a first arm and a second arm.

25. The bracket of claim 24, wherein said third support is attached to said first arm of said second base.

26. An electrical connector support system comprising:

a bracket comprising:

a base comprising a rear portion, a front portion, two sides and a central side therebetween, wherein said two sides and said central side define an opening that is not totally enclosed, and wherein a portion of said central side faces said opening but does not face said base;

a second base positioned above and in front of said front portion of said base;

an electrical connector attached to said bracket and positioned over said second base so as not to be supported on said second base.

27. The electrical connector support system of claim 26, wherein no other electrical connectors besides said electrical connector are attached to said bracket.

28. The electrical connector support system of claim 26, wherein said electrical connector comprises a VGA port.

29. The electrical connector support system of claim 26, wherein said electrical connector comprises a D-Sub.

30. The electrical connector support system of claim 26, comprising a second electrical connector positioned below said second base.

31. The electrical connector support system of claim 27, comprising a second electrical connector positioned below said second base.

32. The electrical connector support system of claim 30, wherein said second electrical connector is positioned in front of said front portion of said base.

33. The electrical connector support system of claim 30, wherein said second electrical connector comprises a mini-Din.

34. The electrical connector support system of claim 26, comprising a PC board to which said bracket is attached and to which said connector is electrically attached.

35. The electrical connector support system of claim 30, comprising a PC board to which said bracket is attached and to which said connector and said second connector are electrically attached.

36. The electrical connector support system of claim 31, comprising a PC board to which said bracket is attached and to which said connector and said second connector are electrically attached.

37. The electrical connector support system of claim 30, wherein a front edge of said connector is substantially aligned with and above a front edge of said second connector.

38. The electrical connector support system of claim 26, wherein said bracket comprises a support extending upwardly of said second base and said electrical connector is attached to said support.

39. The electrical connector support system of claim 38, wherein said electrical connector comprises a flange that is positioned in front of said support and is attached thereto.

40. The electrical connector support system of claim 26, wherein said contact is positioned within said opening.

41. The electrical connector support system of claim 26, wherein said base comprises one or more edges that define said opening and wherein one of said one or more edges engages said connector.

42. The electrical connector support system of claim 26, wherein said base is U-shaped comprising a first arm and a second arm and said connector is positioned between a space defined between said first and second arms.

43. The electrical connector support system of claim 42, wherein said connector engages said first arm.

* * * * *